US005156563A

United States Patent [19]

Park et al.

[11] Patent Number: 5,156,563

[45] Date of Patent: Oct. 20, 1992

[54] PROCESS FOR MANUFACTURING COLOR PICTURE TUBE CAPABLE OF MINIMIZING THERMAL DEFORMATION OF SHADOW MASK

[75] Inventors: Kyung-Soon Park, Kyongki-Do; Hun-Soo Kim, Seoul, both of Rep. of Korea

[73] Assignee: Samsung Electron Devices Co., Ltd., Kyongki, Rep. of Korea

[21] Appl. No.: 719,296

[22] Filed: Jun. 25, 1991

[30] Foreign Application Priority Data

Jun. 25, 1990 [KR] Rep. of Korea ..... 90-9428
Jun. 18, 1991 [KR] Rep. of Korea ..... 91-10038

[51] Int. Cl.[5] ..... H01J 9/39
[52] U.S. Cl. ..... 445/11; 445/41; 445/55
[58] Field of Search ..... 445/11, 14, 19, 36, 445/47, 58, 55, 41

[56] References Cited

U.S. PATENT DOCUMENTS 3,802,757 4/1974 Benda et al. ..... 445/19
4,203,860 5/1980 Ichise et al. ..... 252/181.2
4,416,642 11/1983 van Ormer ..... 445/11
4,481,441 11/1984 van Gils ..... 445/55

FOREIGN PATENT DOCUMENTS 62-35434 2/1987 Japan .
60-72143 5/1987 Japan .
62-100934 5/1987 Japan .
2-10626 1/1990 Japan .
2-10627 1/1990 Japan .

*Primary Examiner*—Kenneth J. Ramsey
*Attorney, Agent, or Firm*—Cushman Darby & Cushman

[57] ABSTRACT

A process for manufacturing a color picture tube capable of minimizing the thermal deformation of the shadow mask is disclosed. A getter is filled with a Ba material, a high or low vaporizing material having a different vaporizing temperature compared with that of the Ba material, and the getter is installed within the color picture tube. The getter is heated by a microwave heating device, so that the Ba material is vaporized so that the vacuum level of the color picture tube is raised. The high or low vaporizing material is vaporized and coated onto an aluminum film of a panel or on the surface of the shadow mask. This vaporizing material layer coated on the aluminum film or on the surface of the shadow mask absorbs the heat generated by the shadow mask, so that the thermal expansion and the thermal deformation of the shadow mask is inhibited, thereby improving the colorimetric purity of the phosphor screen and extending the life expectancy of the color picture tube.

10 Claims, 3 Drawing Sheets

PROCESS FOR MANUFACTURING COLOR PICTURE TUBE CAPABLE OF MINIMIZING THERMAL DEFORMATION OF SHADOW MASK

FIELD OF THE INVENTION

The present invention relates to a process for manufacturing a color picture tube, in which the thermal deformation of the shadow mask installed within the color picture tube can be minimized.

BACKGROUND OF THE INVENTION

As shown in FIG. 1, a shadow mask of a color picture tube is generally made of a thin metal plate, and is disposed separated by about 1 cm from the phosphor face of the color picture tube in a state supported by a frame. The shadow mask is provided with about 300–350 thousand tiny holes, and electron beams emitted from an electron gun intersect the phosphor face after passing through the holes of the shadow mask. Thus, the shadow mask performs the function of separating the three basic colors so that the electron beams should be able to produce luminescence on the phosphor screen.

At amount of 15 to 20% of the electron beams emitted from the cathode intersect the phosphor screen through the holes of the shadow mask, but the residual electron beams collide with the surface of the shadow mask. As the electrical energy of the electron beams is converted into thermal energy, the shadow mask is heated to a temperature of about 80° C. and that the central portion of the shadow mask, which has inferior cooling effect to the peripheral portion, is expanded toward the phosphor face, thereby inducing a doming phenomenon due to the fast progress of the thermal expansion within the color picture tube.

Due to the above described phenomenon, many of the tiny holes in the shadow mask are displaced from their original positions. This brings the result that the beams passing through the holes of the shadow mask do not arrive at the originally intended locations on the phosphor coating on the face of the color picture tube, but arrive at other locations on the phosphor coating after changing their travel paths; some land on areas which are not intended to be illuminated at the particular instant of time, and others land overlappingly on adjacent phosphors, thereby producing a thermal drift phenomenon. Consequently, the color harmony is degraded, and the colormetric purity is deteriorated, thereby making it impossible to obtain a proper color image.

Conventionally, in an attempt to overcome the above-described problem, there has been proposed a method in which, in the step of spreading an aluminum film on the inner surface of the picture tube, Mn is added, or the aluminum film is oxidized, so that the rise of the temperature of the shadow mask should be inhibited. However, this method is besieged with disadvantages, such that the process is complicated, and requires high cost. Meanwhile, there is another proposal as disclosed in U.S. Pat. No. 4,203,860 in which the amount of the backflash of the Ba getter is minimized, so that a long term thermal stabilization should be assured, as well as giving a diffraction effect to the getter material. This includes a getter material in the form of a mixed composition, but this has the disadvantage that the thermal expansion and the thermal deformation of the shadow mask can not be effectively inhibited.

In an attempt to overcome the above-described disadvantage, Japanese Patent Laid-open No. Showa 60-72143 discloses a proposal. According to this proposal, the surface of the shadow mask nearer to the electron gun is coated with a glass layer composed of an lead borate glass having a low thermal expansion coefficient, and, on the glass layer, a conductive metal compound including Ba and Al and Ni is coated as a getter film. Owing to the extremely low thermal conductivity of the glass layer, the amount of the heat transferred to the shadow mask is decreased, with the result that the thermal expansion of the shadow mask due to the temperature rise can be remarkably decreased, and that the conductive getter film can prevent the electron beams from electrical charging.

There are still other proposals, such as Japanese Patent Laid-open Nos. Showa 62-35434 and Showa 62-100934. According to these proposals, on the surface of the shadow mask nearer to the electron gun, there is spread a crystalline lead borate glass containing lead oxide (PbO) or silicon nitride ($Si_3N_4$), in order for an electron absorbing layer to be formed. Further, on the electron absorbing layer, a conductive layer containing Ba as the principal ingredient is formed, so that the electrons temporarily charged on the surface of the electron absorbing layer should be inhibited from increasing to a higher density, and that the displacements of the courses of the electron beams should be corrected effectively by means of an electrostatic deflection, thereby effecting inhibition of the doming phenomenon.

However, in the conventional techniques described above, when forming the lead borate glass layer on the surface of the shadow mask, a high temperature heat treating facility is required, and the period of time for performing the process is extended, thereby aggravating the economy of the process.

Recently, to solve the above mentioned problems, there has been proposed a method in Japanese Patent Laid-open Nos. HEISEI 2-10626 and HEISEI 2-10627, where bismuth (Bi) material or bismuth mixed with other components is coated on the shadow mask. However, such a method has a defect that the bismuth material produces moisture ($H_2O$) and $CO_2$ gas due to the temperature rising in case of firing the mixture or colliding with electron beams thereon, thereby decreasing the vacuum level within the color picture tube and deteriorating the emission characteristics of the electron beams.

Meantime, in manufacturing a color picture tube, two methods are incorporated to raise the vacuum level of the color picture tube for the improvement of emission characteristics of the electron beams, namely: an evacuating step of discharging residue air from the color picture tube using a vacuum pump to make the vacuum level about $10^{-6}$ torr, and a getter, flashing step of vaporizing getter material such as Al, Ba compound 10, and Ni compound 21 filled within a getter vessel 22 of getter 7, as shown in FIG. 2, by heating the getter material through a microwave heating means to absorb residual gas molecules, which enhance the vacuum level to about $10^{-7}$ torr.

SUMMARY OF THE INVENTION

The present inventors came to complete the invention by taking a hint such that a separate material having a different vaporizing temperature compared with the getter material, such as Ba material (referred to as vaporizing material hereinafter), may be incorporatedly disposed within the getter vessel, and the vaporizing material may be vaporized before or after the getter-flashing step, to be coated on the aluminum film of the face plate or on the surface of the shadow mask, thereby absorbing the heat generated from the shadow mask to restrain the doming phenomenon thereof.

The present invention is intended to overcome the above described disadvantages of the conventional techniques.

Therefore it is an object of the present invention to provide a process for manufacturing a color picture tube, in which the heat generated from the shadow mask can be effectively absorbed to minimize the thermal deformation of the shadow mask, whereby the colormetric purity can be improved.

It is another object of the present invention to provide a process for manufacturing a color picture tube which can lower the manufacturing cost by utilizing a conventional getter-flashing step without any needs of further facilities.

In achieving the above objects, the manufacturing process according to the present invention comprises: assembling a getter which is formed by filling an getter material including a Ba material, an Ni material, and a vaporizing material having a different vaporizing temperature compared with that of the getter material, into a getter vessel through an interposed getter antenna to an electron gun; installing the assembled getter to the funnel portion of the picture tube after sealingly coupling the funnel portion with the panel portion of the picture tube with the shadow mask secured thereto; sealing the picture tube after evacuating the residue air to enhance the vacuum level of the picture tube; vaporizing the getter material by primarily heating it to a prescribed temperature through a microwave heating means in order to further raise the vacuum level of the interior of the picture tube; and vaporizing the vaporizing material by secondly heating it to a temperature lower or higher than that of the getter material in order to coat the vaporizing material of the getter onto the aluminum film of the panel or onto the surface for the shadow mask.

The vaporizing material according to the present invention may be classified into two groups. One group is a vaporizing material such as Mn material whose vaporizing temperature is above that of the Ba material referred to as a high vaporizing material hereinafter. The other group is a vaporizing material such as at least one material selected from the group consisting of Bi, $Bi_2O_3$, Ge, Mg, Pb, PbO, Sb, $Sb_2O_3$, Sn, and Zn, whose vaporizing temperature is below that of the Ba material, referred to as a low vaporizing material hereinafter. The high or low vaporizing material has its own vaporizing temperature, but it has all the same function in which it is vaporized and coated on the surface of the internal component of the color picture tube, such as the Al film of the panel or shadow mask, to form a vaporized layer thereon, whereby the vaporized layer is apt to absorb the heat from the shadow mask to decrease the doming phenomenon thereof.

BRIEF DESCRIPTION OF THE DRAWINGS

The above object and other advantages of the present invention will become more apparent from the following description in detail of a preferred embodiment of the present invention with reference to the attached drawings, in which.

DESCRIPTION OF THE PREFERRED EMBODIMENTS

Figure 1:
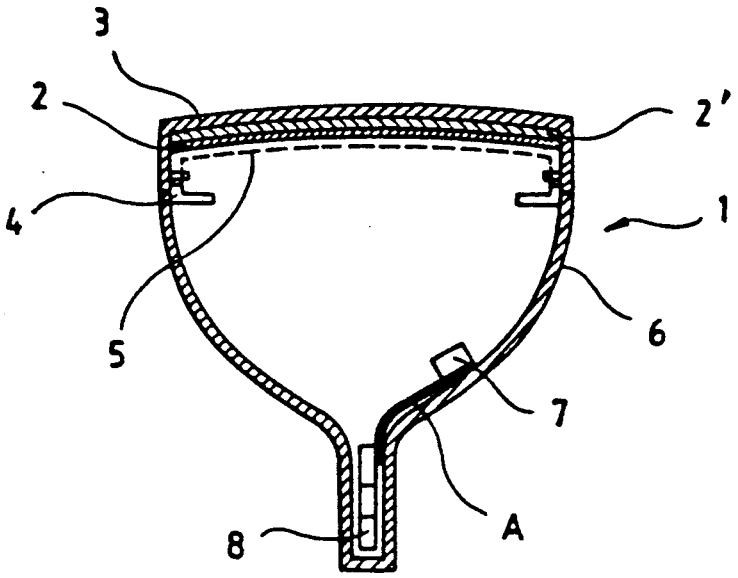
FIG. 1 is a sectional view schematically showing the internal structure of a color picture tube which may be made using the process of the present invention.
Figure 2:
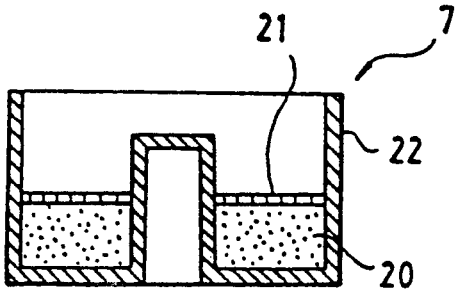
FIG. 2 (PRIOR ART)
FIG. 2 is a sectional view showing the structure of a conventional getter.

FIG. 1 is a sectional view showing the internal structure of the usual color picture tube. In this drawing, reference numeral 1 indicates a color picture tube, and this color picture tube 1 includes a panel 3 with a phosphor face 2' and a aluminum film 2 coated thereon, a shadow mask 5 with a plurality of through-holes formed therein, and supported by a frame 4 separated by about 1 cm from the aluminum film 2 which is spread on the inner face of the panel 3, a getter 7 installed along the inner wall of a funnel portion 6, of the tube for absorbing the gases upon being heated by a microwave heating means, and an electron gun 8 installed within the neck portion of the funnel portion 6, and consisting of a plurality of electrodes.

Figure 3:
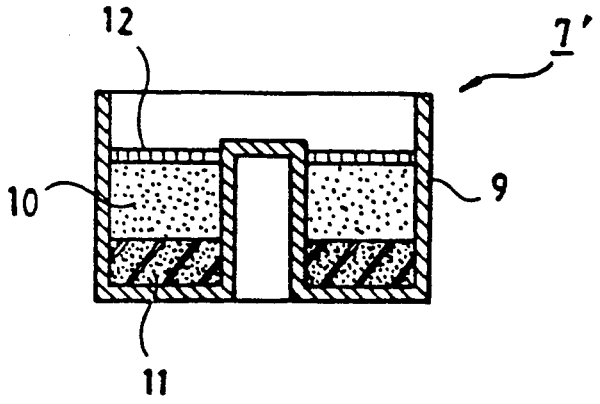
FIG. 3 is a sectional view showing the structure of the getter used in accordance with a first embodiment of the present invention.

As shown in FIG. 3, the getter 7' in accordance with a first embodiment of the present invention is constituted such that: a getter container 9 is filled with a high vaporizing material 11 such as an Mn material whose vaporizing temperature is higher than that of a Ba material 10. Upon the high vaporizing material 11, there is provided a layer filled with a Ba material 10 which is capable of absorbing the internal gas of the picture tube upon being heated to evaporation under a sealed state; and, upon the Ba material 10, there is coated an Ni material 12 for preventing the oxidation of the Ba material 10.

As described above, the getter 7' which is filled with the high vaporizing material 11, the Ba material 10 and the Ni material 12, is attached by means of a getter antenna A, to a sealed cup (not shown) of the electron gun 8, so that the getter 7' can be assembled to the neck portion of the picture tube 1 in a unitized form with the electron gun 8. Then the panel 3, on which the aluminum film 2 is spread and on which the shadow mask 5 is secured, is sealingly coupled with the funnel portion 6, and then, the electron gun 8 combined with the getter 7' is installed into the neck portion of the picture tube 1. Then, the residual air remaining within the picture tube is discharged by a mechanical means, and then, a final sealing is carried out, thereby completing the manufacturing of the picture tube 1.

After installing the getter 7' into the funnel portion 6 in the manner described above, the getter 7' disposed within the picture tube 1 is heated by a microwave heating means by mounting the picture tube 1 on a microwave heating apparatus (not shown) in order to step-up the vacuum level of the picture tube 1. When the getter 7' is heated to a temperature of 1130° C., the Ba material 10 which is disposed on the upper portion of the getter vessel 9 is vaporized, and these Ba vapors adsorb the residual air remaining within the picture tube 1, thereby raising the vacuum level of the picture tube 1.

After raising the vacuum level of the picture tube 1 by vaporizing the Ba material 10, the high vaporizing material 11 is vaporized. That is, if the getter 7' is heated to a temperature above 1130° C., i.e., 1250° C., the Mn material disposed on the getter 7' is vaporized, and the vaporized Mn material is uniformly coated onto the aluminum film 2 of the panel 3 or on the surface of the shadow mask 5.

Accordingly, the heat generated by the electrons which do not pass through holes of the shadow mask 5 but collide with the shadow mask 5 is absorbed into the black Mn material layer formed on the aluminum film 2 or on the surface of the shadow mask 5, thereby retarding the temperature rise of the shadow mask 5. Consequently, the thermal deformation due to the thermal expansion of the shadow mask 5 is inhibited, and the doming phenomenon and the thermal drifting phenomenon occurring to the shadow mask 5 are decreased, so that the electron beam separating function should be performed in an acceptable manner. Consequently, the electron beams land on the accurate positions of the phosphor face after passing through the holes of the shadow mask 5, with the result that the colormetric purity is maintained at a high level.

Now the effect of the present invention as described above will be described in further detail in comparison with the conventional techniques.

Table 1 shows a comparison of the brightness and the thermal drifting amounts for the conventional techniques and the present invention. In Table 1, a conventional color picture tube with an aluminum film 2 deposited on the inner face of the panel 3, and the picture tube of the present invention with the Mn material absorbed into the aluminum film 2 or on the surface of the shadow mask 5 are assumed. As for the thermal drifting amount $TD_A$, the thermal drifting amount $TD_A$ for the 30 mm×30 mm points to the left and right upper portion of the panel 3 (to be called hereinafter A points), and the thermal drifting amount $TD_A$ for the points separated by 50 mm to the left and right from the center of the panel 3 are shown in absolute values. Further, in Table 1, Test 1 of the present invention shows the measured values for picture tube samples 1, 2 and 3 on which 0.02g of Mn is deposited, while Test 2 shows the values for picture tube samples 4 and 5 on which 0.04 g of Mn is deposited.

TABLE 1

Comparison of brightness and thermal drift for the conventional technique and the present invention.

| | | Brightness (F/L) | | | Thermal drift (μ) | |
|---|---|---|---|---|---|---|
| | | R | G | B | A point | B point |
| Conventional technique | | 36.6 | 127.9 | 23.9 | 25 | 27 |
| Test 1 | Sam. 1 | 35.3 | 123.4 | 23.6 | 20 | 15 |
| of the present | Sam. 2 | 35.9 | 129.8 | 23.6 | 18 | 18 |
| invention | Sam. 3 | 36.4 | 128.9 | 24.3 | 23 | 18 |
| Test 2 | Sam. 4 | 34.2 | 127.4 | 24.7 | 23 | 20 |
| of the present invention | Sam. 5 | 37.4 | 136.2 | 26.0 | 18 | 25 |
| Average value | | 35.8 | 129.1 | 24.3 | 20.4 | 19.2 |

TABLE 1-continued

Comparison of brightness and thermal drift for the conventional technique and the present invention.

| | Brightness (F/L) | | | Thermal drift (μ) | |
|---|---|---|---|---|---|
| | R | G | B | A point | B point |
| Variation (%) | −2.2 | +1.0 | +2.3 | −18 | −29 |

That is, as shown in Table 1, the average value of brightness of the first and second tests of one embodiment of the present invention is decreased by 2.2% compared with that of the conventional technique for the red color, increased by 1.0% for the green color, and increased by 2.3% for the blue color. By this fact, it can be assessed that the color picture tube according to the present invention has almost the same brightness as that of the conventional picture tube.

As for the thermal drifting values TD as against the temperature rise of the shadow mask 5, the average value of $TD_A$ for the present invention is decreased by about 18% compared with that of the conventional technique, and the average value of $TD_B$ is decreased about 29% compared with that of the conventional technique. This reflects the fact that a significant portion of the heat generated by the shadow mask 5 is absorbed by the Mn material layer formed on the aluminum film 2 or on the surface of the shadow mask 5 so that the temperature rise is inhibited.

Figure 6:
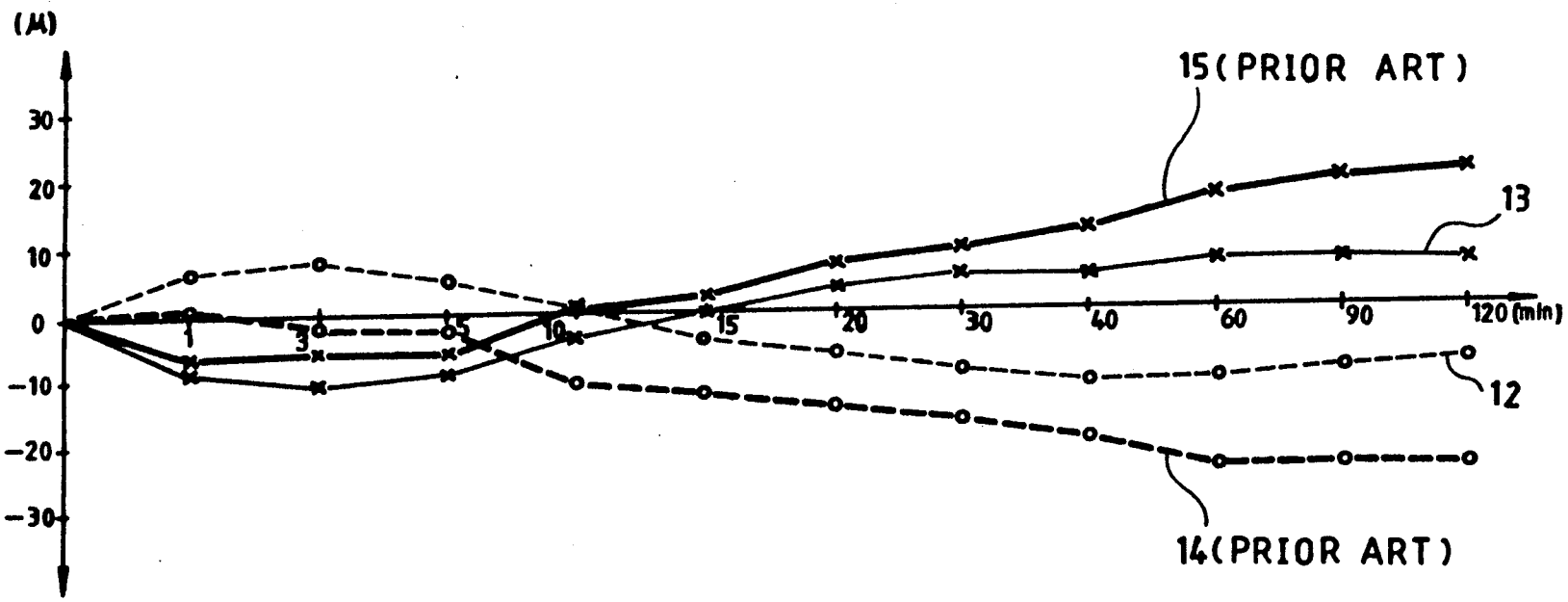
FIG. 6 is a graphical illustration showing the variation in thermal drift in operation of a color picture tube made according to the conventional technique and a color picture tube made according to the present invention.

Meanwhile, FIG. 6 illustrates the variation of the thermal drifting amounts as against the elapsing of time for the picture tube of the present invention compared with the picture tube made by the method of the conventional technique. Here, the lines 12 and 13 represent the variations made by the average values of $TD_A$ and $TD_B$ for the picture tubes of tests 1 and 2 of the first embodiment of the present invention, while the lines 14 and 15 represent the variations for the average values of $TD_A$ and $TD_B$ for the picture tube made by the conventional technique.

To see into the variations of the thermal drifting amounts $TD_A$ and $TD_B$ at the points A and B of the color picture tube, there is no great difference between the doming amounts of the shadow masks of the conventional technique and the present invention for the initial 5–10 minutes. However, after elapsing of a certain period of time, the values $TD_A$ and $TD_B$ of the picture tube according to the present invention show stabilized values at less than 10μ, while the values $TD_A$ and $TD_B$ are increased to over 20μ, thereby making it apparent that the variation of the thermal drifting amount for the picture tube according to the present invention is remarkably reduced.

As described above, a first embodiment of the present invention discloses the doming phenomenon can be decreased by forming vaporized material layer on the internal components of the color picture tube with a high vaporizing material having a higher vaporizing temperature than that of the Ba material.

This invention can be modified by using a low vaporizing material having a lower vaporizing temperature than that of the Ba material such as Bi, $Bi_2O_3$, Ge, Mg, Pb, PbO, Sb, $Sb_2O_3$, Sn, and Zn. We will explain a second embodiment of the present invention hereinafter.

Figure 4:
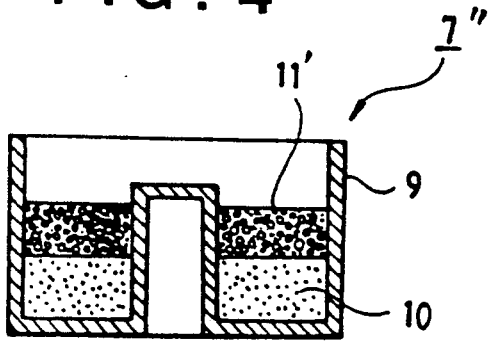
FIG. 4 is a sectional view showing the structure of the getter used in accordance with a second embodiment of the present invention.

The structure of the getter 7'' according to the second embodiment of this invention, as shown in FIG. 4, is similar to the one described in relation to the first embodiment of the this invention, except that a low vaporizing material 11″ is filled upon the getter material 10 within the getter vessel 9. Further, since the assembling or mounting operation of the getter 7″ in accordance with the second embodiment within the color picture tube is the same as in the first embodiment, we will omit the detailed descriptions thereof.

When the getter 7″ in accordance with the second embodiment is heated to the prescribed temperature of the low vaporizing material 11″ which is lower than that of the getter material, the low vaporizing material 11′ is vaporized and coated on the A1 film 2 of the panel 3 or on the surface of the shadow mask 5. Therefore, the A1 film 2 of the panel 3 or the surface of the shadow mask 5 is formed with a vaporized material layer, whereby, as described in relation to the first embodiment of this invention, the heat generated from the shadow mask 5 due to the collision of the electron beams is absorbed so as to restrain the temperature rise of the shadow mask.

In the first and the second embodiment of this invention as described above, the vaporizing step of the high or low vaporizing material 11, 11′ is performed continiously before or after getter-flashing step of the getter material, i.e., Ba material 10. As, another embodiment of this invention, the step of vaporizing the high or low vaporizing material 11, 11′ can be performed during the evacuating step, in which residue air within the color picture tube 1 is discharged by a vacuum pump.

Figure 5:
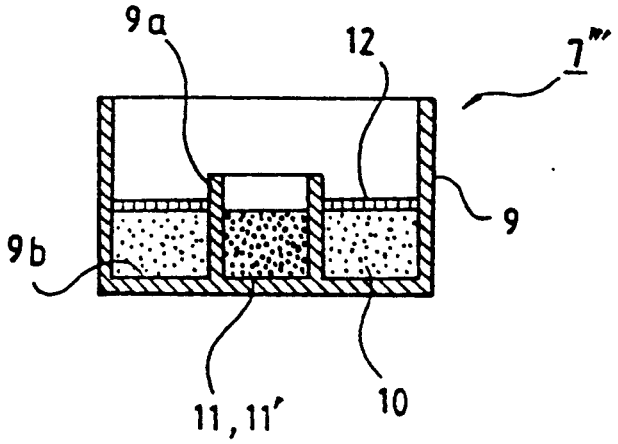
FIG. 5 is a sectional view showing the structure of the getter used in accordance with still another embodiment of the present invention.

Moreover, the getter vessel 9 can be modified as shown in FIG. 5. The high or low vaporizing material 11, 11′ may be filled within a central cup portion 9*a*, and the getter material, such as Ba material 10, may be filled within a ring shaped portion 9*b*. The getter 7‴ as shown in FIG. 5 has advantages that, in the vaporizing steps of the getter material and high or low vaporizing materials in turns, the effects of the remaining material produced in the preceding vaporizing operation can be minimized. Besides, other operations and effects are almost the same as described in relation to the first and second embodiment, so we will omit the detailed descriptions thereof.

According to the present invention as described above, the high or the low vaporizing material 11, 11′ which is filled in the getter 7′, 7″, 7‴ is vaporized by a microwave heating means, and coated onto the aluminum film 2 or on the surface of the shadow mask 5. Then, the vaporized layer absorbs the heat generated by the shadow mask 5 to such an extent that the shadow mask 5 is prevented from being heated to a high temperature. This brings the result that the doming and thermal drifting amounts are minimized, so that the shadow mask 5 should be able to perform the color separating function in an acceptable manner. Consequently, the colormetric purity of the picture tube is improved, and a shadow mask 5 and the picture tube 1 having a high quality can be manufactured in a low cost manner because of utilizing existing conventional facilities.

What is claimed is:

1. A process for manufacturing a color picture tube having a shadow mask which has decreased thermal deformation in use, said process comprising:

(a) assembling a getter filled with a vaporizing material, and a getter material comprising Ba material, by a getter antenna, to an electron gun thereby constituting an electron gun and getter assembly;

(b) installing said assembly into a funnel portion of a picture tube after sealingly coupling a forward end of a funnel portion with an outer periphery of a screen panel having a shadow mask secured thereto;

(c) sealing said color picture tube after evacuating residual air from the interior of said color picture tube;

(d) vaporizing said getter material by heating said getter to a first prescribed temperature using a microwave heating device in order to raise the vacuum level of said interior of said color picture tube; and (e) heating said getter to a second prescribed temperature in order to cause said vaporizing material of said getter to be coated onto at least one of an aluminum film provided on said panel and the surface of said shadow mask;

said vaporizing material comprising a high vaporizing material which vaporizes at a higher temperature than that at which said Ba material vaporizes, said second prescribed temperature being higher than said first prescribed temperature.

2. A process for manufacturing a color picture tube in accordance with claim 2, wherein:

said high vaporizing material comprises Mn.

3. A process for manufacturing a color picture tube in accordance with claim 2, wherein:

step (e) is conducted simultaneously with the air-evacuating portion of step (c).

4. A process for manufacturing a color picture tube in accordance with claim 1, wherein:

step (e) is conducted before the air-evacuating portion of step (c).

5. A process for manufacturing a color picture tube in accordance with claim 1, wherein:

step (e) is conducted after the air-evacuating portion of step (c).

6. A process for manufacturing a color picture tube having a shadow mask which has decreased thermal deformation in use, said process comprising:

(a) assembling a getter filled with a vaporizing material, and a getter material comprising Ba material, by a getter antenna, to an electron gun thereby constituting an electron gun and getter assembly;

(b) installing said assembly into a funnel portion of a picture tube after sealingly coupling a forward end of a funnel portion with an outer periphery of a screen panel having a shadow mask secured thereto;

(c) sealing said color picture tube after evacuating residual air from the interior of said color picture tube;

(d) vaporizing said getter material by heating said getter to a first prescribed temperature using a microwave heating device in order to raise the vacuum level of said interior of said color picture tube; and (e) heating said getter to a second prescribed temperature in order to cause said vaporizing material of said getter to be coated onto at least one of an aluminum film provided on said panel and the surface of said shadow mask;

said vaporizing material comprising a low vaporizing material which vaporizes at a lower temperature than that at which said Ba material vaporizes, said first prescribed temperature being higher than said second prescribed temperature.

7. A process for manufacturing a color picture tube in accordance with claim 6, wherein:

said low vaporizing material is at least one material selected from the group consisting of Bi, $Bi_2O_3$, Ge, Mg, Pb, PbO, Sb, $Sb_2O_3$, Sn, and Zn.

8. A process for manufacturing a color picture tube in accordance with claim 6, wherein:

step (e) is conducted simultaneously with the air-evacuating portion of step (c).

9. A process for manufacturing a color picture tube in accordance with claim 6, wherein:

step (e) is conducted before the air-evacuating portion of step (c).

10. A process for manufacturing a color picture tube in accordance with claim 6, wherein:

step (e) is conducted after the air-evacuating portion of step (c).

* * * * *